US005932083A

United States Patent [19]

Stoffer et al.

[11] Patent Number: 5,932,083

[45] Date of Patent: Aug. 3, 1999

[54] ELECTRODEPOSITION OF CERIUM-BASED COATINGS FOR CORROSION PROTECTION OF ALUMINUM ALLOYS

[75] Inventors: James O. Stoffer; Thomas J. O'Keefe; Xuan Lin; Eric Morris; Pu Yu, all of Rolla, Mo.; Srinivas Pravin Sitaram, Norwood, Mass.

[73] Assignee: The Curators of the University of Missouri, Columbia, Mo.

[21] Appl. No.: 08/928,899

[22] Filed: Sep. 12, 1997

[51] Int. Cl.[6] ..... C25D 3/00; C25D 11/18; C23C 28/00

[52] U.S. Cl. ..... 205/261; 205/194; 205/203

[58] Field of Search ..... 205/194, 203, 205/261

[56] References Cited

FOREIGN PATENT DOCUMENTS

WO 88/06639 9/1988 WIPO .

OTHER PUBLICATIONS

Aldykiewicz, Jr., et al., Studies of the Formation of Cerium–Rich Protective Films Using X–Ray Absorption Near–Edge Spectroscopy and Rotating Disk Electrode Methods, J. Electrochem, Soc., vol. 143, No. 1, Jan. 1996, pp. 147–153.

Hinton, et al., Cerium Conversion Coatings for the Corrosion Protection of Aluminum, Materials Forum, vol. 9, No. 3, 1986, no month available, pp. 162–173.

Hinton, et al., Cerium Oxide Coatings for Corrosion Protection of Aluminum Alloys, Materials Australasia, Jan./Feb. 1987, pp. 18–20.

Aldykewicz, Jr., et al., The Investigation of Cerium as a Cathodic Inhibitor for Aluminum–Copper Alloys, J. Electrochem Soc., vol. 142, No. 10, Oct. 1995, pp. 3342–3350.

Davenport, et al., Xanes Investigation of the Role of Cerium Compounds as Corrosion Inhibitors for Aluminum, Corrosion Science, vol. 32, No. 5/6, pp. 653–663, 1991, no month available.

Weiser, The Hydrous Oxides, McGraw–Hill Book Company, Inc., 1926, no month available, pp. 252–259.

Hinton, et al., The Inhibition of Aluminum Alloy Corrosion by Cerous Cations, Metals Forum, vol. 7, No. 4, 1984, no month available, pp. 211–217.

Mansfeld, et al., Corrosion Protection of Al Alloys and Al–based Metal Matrix, Corrosion 88, Mar. 21–25, 1988 paper 380, NACE pp.1–19.

Davenport et al., X–Ray Absorption Study of Cerium in the Passive Film on Aluminum, J. Electrochem Soc., vol. 136, No. 6, Jun. 1989, pp. 1837–1838.

Hinton, New Approaches to Corrosion Inhibition with Rare Earth Metal Salts, Corrosion 89, Apr. 17–21, 1989, paper 170, NACE pp.1–20.

Hinton, et al., The Corrosion Inhibition of Zinc with Cerous Chloride, Corrosion Science, 29, 1989, no month available, pp. 967–984.

Hinton, Corrosion Inhibition with Rare Earth Metal Salts, Journal of Alloys and Compounds, 180, 1992, no month available, pp. 15–25.

Hinton et al., "Cerium Oxide Coatings For Corrosion Protection of Aluminum Alloys", Materials Australasia, pp. 18–20, Feb. 3, 1987.

*Primary Examiner*—Kathryn Gorgos
*Assistant Examiner*—Edna Wong
*Attorney, Agent, or Firm*—Senniger, Powers, Leavitt & Roedel

[57] ABSTRACT

A process for enhancing the corrosion resistance of an aluminum-containing component with a cerium based coating. An aluminum-containing cathode and an oxygen-evolving anode are immersed in an electrolyte comprising water, solvent, oxidizing agent and cerium ions. An electrical current is passed through the electrolyte by applying electrical current to deposit a cerium based coating onto the cathode. An electrolyte for use in depositing a cerium based coating. An electrodeposited cerium-based coating. An aluminum aircraft structural component having a cerium-based coating thereon.

22 Claims, No Drawings

ELECTRODEPOSITION OF CERIUM-BASED COATINGS FOR CORROSION PROTECTION OF ALUMINUM ALLOYS

BACKGROUND OF THE INVENTION

This invention was made with government support under grant number AFOSRF49620-96-1-0140 awarded by the United States Air Force. The government has certain rights in the invention.

This invention relates to a method for enhancing the corrosion resistance of aluminum and aluminum alloys by deposition of a cerium-based coating thereon. The invention has particular application for aerospace structural components such as aircraft skin, wing skin and other sheet components manufactured from aluminum or aluminum alloys, especially sheet and bulk structural pieces, or in other applications where long-term corrosion resistance is desired.

Many aerospace components are constructed from aluminum or aluminum alloys due to their superior strength to weight ratio. Aluminum and aluminum alloys, however, are subject to corrosion upon exposure to water condensed from humid air and contaminated from other sources with salt, rain, snow, ocean salt, salt applied to runways, and other environmental conditions, which can lead to catastrophic failure. Heretofore the corrosion resistance of aluminum and aluminum alloys has been enhanced by the use of chromate conversion coatings. A conversion coating is a coating consisting of metallic salts, such as chromate, which form during and after dissolution of a metallic element, such as chromium or aluminum, or are precipitated from salts onto a substrate. A disadvantage of chromate coatings, however, is their toxicity, as ingestion or inhalation of chromates has been determined to cause kidney failure, liver damage, blood disorders, lung cancer and eventually death. Corrosion resistance has also been enhanced by anodizing. However, anodizing is known to cause fatigue problems leading to failure of aluminum components.

SUMMARY OF THIS INVENTION

Among the several objects of this invention, therefore, is the enhancement of the corrosion resistance of aluminum and aluminum alloy aircraft components; the enhancement of corrosion resistance of such components without reducing fatigue resistance; the enhancement of the corrosion resistance of aluminum and aluminum alloys using materials which are not toxic in the relevant concentrations; the enhancement of the corrosion resistance of aluminum and aluminum alloys using a cerium-based coating produced by electrodeposition resulting in spent electrolyte having minimal negative environmental impact.

Briefly, therefore, the invention is directed to a process for enhancing the corrosion resistance of an aluminum-containing component by immersing an aluminum-containing cathode and an oxygen-evolving anode in an electrolyte comprising water, solvent, and cerium ions, and passing an electrical current through the electrolyte by applying electrical current to the anode. The current has a current density of from about 1 amp/ft$^2$ to about 50 amps/ft$^2$. A cerium-based coating is deposited onto the aluminum-containing substrate, the coating having a thickness of at least about 0.1 microns and a continuous surface area of at least about 15 in$^2$.

The invention is also directed to a process for enhancing the corrosion resistance of an aluminum-containing component by immersing an aluminum-containing cathode and an oxygen-evolving anode in an electrolyte having an initial pH in the range of from about 1 to about 1.5 comprising water, a solvent, and cerium ions. An electrical current is passed through the electrolyte by applying electrical current having a current density of from about 1 amp/ft$^2$ to about 50 amps/ft$^2$ to the anode to deposit a cerium-based coating onto the aluminum-containing substrate. The deposited coating has a thickness of at least about 0.1 microns and a continuous surface area of at least about 15 in$^2$.

The invention is further directed to process for enhancing the corrosion resistance of an aluminum-containing component by immersing an aluminum-containing cathode and an oxygen-evolving anode in an electrolyte having an initial pH of from about 1.2 to about 1.3. The electrolyte comprises from about 30% by volume to about 60% by volume alcohol, an initial hydrogen peroxide concentration of from about 1% to about 4% by volume, an initial cerium ion concentration of from about 0.01 to about 0.05 moles per liter, and water. An electrical current is passed through the electrolyte by applying electrical current having a current density of between about 5 amp/ft$^2$ and about 15 amps/ft$^2$ to the anode to deposit a cerium-based coating onto the aluminum-containing substrate, the coating having a thickness of from about 0.1 microns to about 1.0 microns and a continuous surface area of at least about 15 in$^2$.

In another aspect the invention is directed to an electrolyte for use in depositing a cerium-based coating onto a substrate, the electrolyte having a pH of from about 1.0 to about 1.5 and comprising from about 30% by volume to about 60% by volume alcohol, from about 1% to about 4% by volume hydrogen peroxide, from about 0.01 to about 0.3 moles per liter cerium ions, and water.

A further aspect of the invention is an electrodeposited cerium-based coating having a continuous surface area of at least about 15 in$^2$ and a thickness of at least about 0.1 microns.

The invention is also directed to a structural aircraft component comprising a substrate comprising at least about 85% aluminum by weight to which is adhered a cerium-based coating having a continuous surface area of at least about 15 in$^2$ and a thickness of at least about 0.1 microns.

Other objects and features of the invention will be in part apparent, and in part described hereafter.

DETAILED DESCRIPTION OF THIS INVENTION

Cerium (Ce) is a malleable, ductile metallic element having an atomic number of 58 and an atomic weight of 140.12. It is the most abundant of the rare earth metallic elements. Cerium possesses highly stable oxides, $CeO_2$ or $Ce_2O_3$, in the oxidation states of 3 and 4. Cerium ions are precipitated to form an oxide adsorbed readily on the surface of $Al(OH)_3$ or $Al_2O_3$ to provide a $CeO_2$ coating which provides extensive corrosion protection. A cerium-based coating is a coating formed by the precipitation of cerium salts onto a substrate. The preferred cerium-based coatings are cerium oxide and hydrated cerium oxide. The cerium-based coating of the invention enhances corrosion resistance by enhanced barrier protection and electrochemical protection.

In one aspect the invention consists of an electrodeposited cerium-based coating on an aluminum or aluminum alloy structural component, which coating is of relatively uniform thickness, is blister-free, and strongly adhered to the component. The coating has a continuous surface area of at least about 15 in.$^2$ and a thickness of at least about 0.1 microns, preferably from about 0.1 to about 1.0 microns, and more preferably about 0.3 microns. An electrodeposited cerium-based coating significantly thicker than about 1.0 micron, it has been discovered, sometimes suffers from cracking and delamination.

In another aspect the invention consists of an aluminum or aluminum alloy structural component having the cerium-based coating described above. Examples of such structural components include aircraft components including the skin of an aircraft fuselage and wing, panels, clamps, brackets and other components. Other coated components, include, more generally, structural components (not limited to aircraft components) comprising aluminum or alloys comprising at least about 85% aluminum by weight such as, for example, 2000, 3000, 6000 and 7000 series aluminum alloys generally, alloys 7025 aluminum, 2024 aluminum, 3003 aluminum specifically.

In accordance with the process of the invention, an electrolytic solution containing cerium is obtained by dissolving a cerium-containing compound in a solvent. In general, the cerium-containing compound is a cerium salt and the solvent is a glycol and water. A preferred electrolyte has an initial cerium ion concentration at the beginning of electrodeposition of from about 0.01 to about 1 moles per liter cerium ions, more preferably from about 0.01 to about 0.3 moles per liter cerium ions, still more preferably from about 0.01 to about 0.05 moles per liter cerium ions, and most preferably about 0.03 moles per liter cerium ions.

A preferred electrolyte is obtained by dissolving cerium nitrate [$Ce(NO_3)_3 \cdot 6H_2O$] in alcohol, glycol, glycerol or polyhydroxyl, in particular in a glycol such as ethylene glycol or propylene glycol as a solvent. A glycol solvent is preferred because it has been found to provide the ideal viscosity and/or surface tension for electrodeposition according to the method of the invention. The electrolyte has volume ratio of glycol: water in the range of between about 0.5:1 and about 2:1, preferably between about 0.8:1 and about 1.2:1, more preferably about 1:1. One preferred electrolyte, after all mixing, consists of between about 0 and about 90% by volume glycol, more preferably from about 30 to about 60% by volume glycol, most preferably about 50% by volume glycol.

Hydrogen peroxide or another suitable oxidizing agent such as ozone, nitric acid, hypochlorite or the like is added to the bath as an oxidizing agent to facilitate formation of cerium oxide during deposition. The hydrogen peroxide may be added to the solution prior to mixing with water, or may be added to the mixture of water, solvent and cerium nitrate. The preferred initial hydrogen peroxide composition at the beginning of electrodeposition is between about 0% and about 10% by volume, more preferably from about 1% to about 4% by volume (approx. 0.1 to 1.2 moles/liter), still more preferably from about 1 to about 1.6% by volume, most preferably about 1.3% by volume of the entire bath.

The initial bulk pH of the electrolytic bath at the beginning of electrodeposition is preferably from about 0 to about 2, more preferably from about 1 to 1.5, most preferably about 1.2 to 1.3. It has been discovered that if the local pH at the interface between the cathode and electrolyte is too acidic, the cerium-based compound to be precipitated onto the substrate remains soluble, and does not precipitate, and in fact never deposits to an acceptable degree or in an acceptable morphology. If the local pH is not sufficiently acidic, any deposit which forms has an improper composition and structure. As such, it is critical to maintain the bulk pH at a level which promotes the proper local pH at this interface. In one preferred embodiment where the cerium ion concentration is from about 0.01 to 0.1 moles per liter and where the oxidizing agent is hydrogen peroxide, the critical pH has been determined to be in the range of from about 1.2 to 1.3.

A pure aluminum or aluminum alloy substrate which is to be the subject of corrosion resistance enhancement is provided as a cathode. The aluminum alloy preferably consists of at least about 85% aluminum by weight. Examples of aluminum alloys suitable for use as substrates include 2000, 3000, 6000 and 7000 series aluminum alloys generally, alloys 7025 aluminum, 2024 aluminum, 3003 aluminum specifically. Without being bound to a particular theory, it appears that the cerium-based coating precipitates onto the aluminum substrate. The substrate is optionally treated, for example, by cleaning and deoxidation to promote good adhesion of the conversion coating.

An anode is provided to supply current to the electrolytic bath. An anode material is selected which is oxygen-evolving, stable, does not passivate, and does not dissolve in an electrolytic bath of water, solvent, hydrogen peroxide, and cerium salts. Examples of suitable electrodes are platinum foil, stainless steel, lead dioxide or a dimensionally stable anode (DSA) material, for example, ruthenium oxide or other platinum group metal oxide powder fused to a titanium or stainless steel substrate.

The cathode and anode are immersed in the electrolytic bath and continuous current is passed through the solution between the electrodes resulting in the electrolytic cathodic precipitation of a cerium-based coating onto the aluminum or aluminum alloy cathode surface. Hydrogen is generated at the cathode by the reaction:

$$2H^+ + 2e^- \rightarrow H_2$$

Followed by other reactions at the cathode, such as:

$$4Ce^{3+} + O_2 + 4OH^- + 2H_2O \rightarrow 4Ce(OH)_2^{2+}$$

$$Ce(OH)_2^{+2} + 2OH^- \rightarrow CeO_2 + H_2O$$

It is believed that the oxidation state of the cerium deposited is +4 and possibly +3 for a portion of the cerium.

During deposition, the current density is preferably maintained in the range of from about 1 amp/ft$^2$ to about 50 amps/ft$^2$, more preferably about 5 amps/ft$^2$ to about 15 amps/ft$^2$, still more preferably about 8 amps/ft$^2$ to about 12 amps/ft$^2$, most preferably about 10 amps/ft$^2$. It has been discovered that application of greater current density results in improper composition and application of too low a current density results in no coating. The preferred deposition time is about 1 to 10 minutes, more preferably about 2 to 3 minutes, until a coating of the desired thickness is attained. As the coating is deposited, the voltage increases as the substrate becomes insulated by the coating. As a guide, it is noted that deposition proceeds relatively unencumbered at about 4 volts, and that a continuous coating having a thickness of about 0.1 to 1.0 microns is generally deposited by the time the voltage reaches about 8 to 9 volts, and that at about 20 volts the coating is generally too thick and the substrate is too insulated to facilitate further deposition.

The temperature of the electrolytic bath is maintained in the range of from about 0° C. to about 40° C. Too high of a temperature has been discovered to result in a poorly deposited film. The evolution of hydrogen provides sufficient agitation to facilitate diffusion of ions to the interface between the electrode and electrolyte, that it is preferred to not use additional mechanical agitation.

The spent electrolyte is recycled and replenished, or is disposed of by conventional, non-hazardous waste water treatment.

After the desired thickness of cerium-based coating is deposited, the supply of current is discontinued and the cathode substrate is removed from the electrolyte. Deposition is usually carried out on a batch, rather than continuous basis. After electrodeposition the cerium-based coated aluminum or aluminum alloy substrate is sealed in a water or phosphate solution maintained from ambient to boiling temperature. A preferred solution contains 2.5 wt. % sodium phosphate at a pH of about 4.5 to 7. Sealing is known in aluminum technology and involves expansion of the lattice of the deposited material, in essence, growing together of the deposited film.

The following examples illustrate the invention.

EXAMPLE 1

Approximately 2000 ml (960 ml water, 960 ml propylene glycol, and 80 ml hydrogen peroxide) of an electrolyte having a pH of about 1.3 was prepared by dissolving 25.6 g hydrated cerium nitrate [$Ce(NO_3)_3 \cdot 6H_2O$] in 960 ml water and 960 ml propylene glycol. Hydrogen peroxide (80 ml of 35% $H_2O_2$) was added to the electrolyte. The resulting electrolyte contained about 0.03 moles per liter cerium. An aluminum alloy plate with a surface area of 18 $in^2$ on one side was cleaned and deoxidized, rinsed with deionized water and provided as the cathode. A piece of platinum with a one-sided surface area of 18 $in^2$ was provided as the anode. Continuous current was provided to the electrolyte by a Sorenson 150-5A P.S. rectifier. The electrolyte was not mechanically agitated. For each variation of the process parameters as set forth in Table 1, a deposit having the thickness stated was deposited.

TABLE 1

| Ex. # | $H_2O_2$ Vol. % | $Ce(NO_3)_3$ conc. M | Sol. Vol % | pH | Current density $A/ft^2$ | Depos. time mins. | Coating thickness mm |
|---|---|---|---|---|---|---|---|
| 1 | 0.4 | 0.03 | 50[1] | 1.3 | 10 | 5 | 0.4 |
| 2 | 1.4 | 0.13 | 50[1] | 1.1 | 10 | 2 | 0.3 |
| 3 | 1.4 | 0.03 | 30[2] | 1.5 | 10 | 3 | 0.3 |
| 4 | 1.4 | 0.03 | 70[2] | 1.1 | 10 | 3 | 0.3 |
| 5 | 1.4 | 0.03 | 35[3] | 1.3 | 10 | 2 | 0.2 |

[1]propylene glycol;
[2]ethylene glycol;
[3]glycerol

The coatings were characterized visually and with a scanning electron microscope and determined to be blister-free, crack-free and of relatively uniform thickness. Electrochemical evaluations using DC polarization and AC impedance were also made.

EXAMPLE 2

The samples from Example 1 were tested according to ASTM-B117 salt spray testing by fogging with 5% NaCl at 38° C. for 336 hrs. Most samples were equal to or better than chromated samples in parallel testing. The cerium-based coatings were tested with and without other topcoats.

In view of the above, it will be seen that the several objects of the invention are achieved.

As various changes could be made in the above embodiments without departing from the scope of the invention, it is intended that all matter contained in the above description shall be interpreted as illustrative and not in a limiting sense.

What is claimed is:

1. A process for enhancing the corrosion resistance of an aluminum-containing component comprising:

immersing an aluminum-containing cathode and an oxygen-evolving anode in an electrolyte having an initial pH in the range of from about 0 to about 2 comprising water, solvent, and cerium ions; and passing an electrical current through the electrolyte to facilitate cathodic precipitation under conditions characterized by a current density of from about 1 $amp/ft^2$ to about 50 $amps/ft^2$ to deposit a cerium-based coating onto the aluminum-containing cathode, said coating having a thickness of at least about 0.1 microns and a continuous surface area of at least about 15 $in^2$.

2. The process of claim 1 wherein the electrolyte has an initial pH in the range of from about 1.2 to about 1.3.

3. The process of claim 1 wherein the electrolyte has an initial cerium ion concentration of from about 0.01 to about 1 moles per liter.

4. The process of claim 3 wherein the electrolyte has an initial cerium ion concentration of from about 0.01 to about 0.3 moles per liter.

5. The process of claim 4 wherein the electrolyte has an initial cerium ion concentration of about 0.03 moles per liter.

6. The process of claim 1 wherein the solvent is selected from the group consisting of aqueous alcohols, glycols, and mixtures thereof.

7. A process for enhancing the corrosion resistance of an aluminum-containing component comprising:

immersing an aluminum-containing cathode and an oxygen-evolving anode in an electrolyte comprising water, solvent, cerium ions, and an oxidizing agent selected from the group consisting of hydrogen peroxide, ozone, hypochlorite, nitric acid and mixtures thereof; and passing an electrical current through the electrolyte to facilitate cathodic precipitation under conditions characterized by a current density of from about 1 $amp/ft^2$ to about 50 $amps/ft^2$ to deposit a cerium-based coating onto the aluminum-containing cathode, said coating having a thickness of at least about 0.1 microns and a continuous surface area of at least about 15 $in^2$.

8. A process for enhancing the corrosion resistance of an aluminum-containing component comprising:

immersing an aluminum-containing cathode and an oxygen-evolving anode in an electrolyte comprising water, solvent, and cerium ions; and passing an electrical current through the electrolyte to facilitate cathodic precipitation under conditions characterized by a current density of from about 1 $amp/ft^2$ to about 50 $amps/ft^2$ to deposit a cerium-based coating onto the aluminum-containing cathode, said coating having a thickness of at least about 0.1 microns and a continuous surface area of at least about 15 $in^2$; and sealing the cerium-based coating.

9. A process for enhancing the corrosion resistance of an aluminum-containing component comprising:

immersing an aluminum-containing cathode and an oxygen-evolving anode in an electrolyte having an initial pH in the range of from about 1 to about 1.5 comprising water, solvent, and cerium ions; and passing an electrical current through the electrolyte by applying electrical current having a current density of from about 1 $amp/ft^2$ to about 50 $amps/ft^2$ to the anode to deposit a cerium-based coating onto the aluminum-containing cathode, said coating having a thickness of at least about 0.1 microns and a continuous surface area of at least about 15 $in^2$.

10. The process of claim 9 wherein the electrolyte has an initial cerium ion concentration in the range of from about 0.01 to about 0.3 moles per liter.

11. The process of claim 9 wherein the electrolyte comprises an initial hydrogen peroxide concentration of between 0 volume percent and about 10 volume percent of the electrolyte.

12. The process of claim 11 wherein the electrolyte has an initial hydrogen peroxide concentration of from about 1 to about 4 volume percent of the electrolyte.

13. The process of claim 12 wherein the electrolyte has an initial hydrogen peroxide concentration of about 1.3 volume percent of the electrolyte.

14. The process of claim 9 wherein the electrolyte comprises from about 30% by volume to about 60% by volume alcohol as the solvent, has an initial hydrogen peroxide concentration of from about 1% to about 4%, and an initial cerium ion concentration of from about 0.01 to about 0.3 moles per liter.

15. The process of claim 9 wherein the electrolyte comprises from about 30% by volume to about 60% by volume solvent selected from the group consisting of alcohol, glycol, glycerol, and polyhydroxyl, has an initial hydrogen peroxide concentration of from about 1% to about 4%, and has an initial cerium ion concentration of from about 0.01 to about 0.3 moles per liter.

16. A process for enhancing the corrosion resistance of an aluminum-containing component comprising:

immersing an aluminum-containing cathode and an oxygen-evolving anode in an electrolyte having an initial pH of from about 1.2 to about 1.3, the electrolyte comprising from about 30% by volume to about 60% by volume alcohol, an initial hydrogen peroxide concentration of from about 1% to about 4% by volume, an initial cerium ion concentration of from about 0.01 to about 0.05 moles per liter, and water; and passing an electrical current through the electrolyte by applying electrical current having a current density of between about 5 amp/$ft^2$ and about 15 amps/$ft^2$ to the anode to deposit a cerium-based coating onto the aluminum-containing cathode, said coating having a thickness of from about 0.1 microns to about 1.0 microns and a continuous surface area of at least about 15 $in^2$.

17. The process of claim 16 comprising sealing the cerium-based coating.

18. The process of claim 17 wherein said sealing is in a phosphate solution maintained from ambient to boiling temperature.

19. The process of claim 18 wherein said sealing is in a sodium phosphate solution at a pH of about 4.5 to 7.

20. An electrolyte for use in depositing a cerium-based coating onto a substrate, the electrolyte having a pH of from about 1.0 to about 1.5 and comprising from about 30% to about 60% by volume alcohol, from about 1% to about 4% by volume hydrogen peroxide, from about 0.01 to about 0.3 moles per liter cerium ions, and water.

21. A process for enhancing the corrosion resistance of an aluminum-containing component comprising:

immersing an aluminum-containing cathode and an oxygen-evolving anode in an electrolyte having an initial pH in the range of from about 1 to about 1.5 comprising water, solvent, and cerium ions; and passing an electrical current through the electrolyte to facilitate cathodic precipitation under conditions characterized by a current density of from about 1 amp/$ft^2$ to about 50 amps/$ft^2$ to deposit a cerium-based coating onto the aluminum-containing cathode, said coating having a thickness of at least about 0.1 microns.

22. A process for enhancing the corrosion resistance of an aluminum-containing component comprising:

immersing an aluminum-containing cathode and an oxygen-evolving anode in an electrolyte having an initial pH of from about 1.2 to about 1.3, the electrolyte comprising from about 30% by volume to about 60% by volume solvent, an initial hydrogen peroxide concentration of from about 1% to about 4% by volume, an initial cerium ion concentration of from about 0.01 to about 0.05 moles per liter, and water; and passing an electrical current through the electrolyte to facilitate cathodic precipitation under conditions characterized by a current density of between about 5 amp/$ft^2$ and about 15 amps/$ft^2$ to deposit a cerium-based coating onto the aluminum-containing cathode, said coating having a thickness of from about 0.1 microns to about 1.0 microns.

* * * * *